US006018821A

United States Patent [19]

Adams

[11] Patent Number: 6,018,821

[45] Date of Patent: Feb. 1, 2000

[54] CONVERTIBLE HEAD APPAREL AND METHOD OF MAKING SAME

[76] Inventor: Kimberly A. Adams, 147 Sunset Hills Dr., Attica, Mich. 48412

[21] Appl. No.: 09/235,702

[22] Filed: Jan. 22, 1999

[51] Int. Cl.[7] ..... A42B 1/04

[52] U.S. Cl. ..... 2/209.11; 2/175.1; 2/DIG. 2

[58] Field of Search ..... 2/171, 175.1, 195.1, 2/202, 209.11, 209.12, DIG. 2

[56] References Cited

U.S. PATENT DOCUMENTS

| | | | |
|---|---|---|---|
| 1,571,107 | 1/1926 | Capelle et al. . | |
| 1,915,092 | 6/1933 | Hendrickson . | |
| 3,072,916 | 1/1963 | Henderson . | |
| 3,187,345 | 6/1965 | Holford | 2/209.11 |
| 5,181,277 | 1/1993 | Sherman . | |
| 5,309,574 | 5/1994 | Balaban et al. . | |
| 5,450,629 | 9/1995 | Gilstrap . | |
| 5,488,740 | 2/1996 | Garza . | |
| 5,579,540 | 12/1996 | Walker . | |
| 5,685,017 | 11/1997 | Kraft . | |
| 5,822,800 | 10/1998 | Anderson . | |

*Primary Examiner*—Diana Oleksa
*Attorney, Agent, or Firm*—Brooks & Kushman P.C.

[57] ABSTRACT

A convertible head apparel of unitary construction is wearable in one of two different hat modes and two different turban modes. The head apparel is constructed with two pockets. One pocket conceals the hat modes when the head apparel is converted for wear in either of the turban modes. The other pocket conceals the turban modes when the head apparel is converted for wear in either of the hat modes. A brim may be added to the hat modes.

12 Claims, 6 Drawing Sheets

CONVERTIBLE HEAD APPAREL AND METHOD OF MAKING SAME

TECHNICAL FIELD

The present invention relates to a multi-piece hat or head apparel of unitary construction which is convertible for wearing in a plurality of modes.

BACKGROUND ART

Hats have been used for many years, and they are available in numerous colors, fabrics, and styles. Most hat designs, however, allow only one mode of wearing. It is often desirable to wear a hat of a certain color, fabric and/or style so that the hat will serve a certain function, e.g., to keep the wearer's head warm, to shield the wearer's face from precipitation and sunlight, to allow the wearer to blend into and appear inconspicuous in a natural setting such as the woods, and/or to look aesthetically pleasing with a certain outfit of the wearer's clothing.

Prior art head apparel constructions can be worn in more than one mode. In such constructions, the wearer must turn the hat inside out by reversing the hat's inner appearance surface, i.e., the surface next to the wearer's head, with the hat's outer appearance surface, i.e., the surface facing away from the wearer's head, to achieve the various modes.

U.S. Pat. No. 5,579,540 which issued Dec. 3, 1996 to Walker discloses a changeable shape clothing accessory which can be used as either a hat or a handbag. The changeable shape clothing accessory can be worn as a hat in three different modes. The changeable shape clothing accessory can be used as a handbag in two different modes. The three different modes of wear as a hat are achieved by means of the reversibility of the hat's inner appearance surface and the hat's outer appearance surface.

U.S. Pat. No. 5,488,740 which issued Feb. 6, 1996 to Garza discloses a reversible and size adjustable hat. The hat can be stitched for wear in two different modes. The two different modes are achieved by reversing the hat's inner appearance surface and the hat's outer appearance surface.

U.S. Pat. No. 5,450,629 which issued Sep. 19, 1995 to Gilstrap discloses an adjustable size convertible hat of hemispherical shape with a foldable visor. The hat has a foldable visor that can be tucked into the shell to form a purse. The hat can be worn in only one mode. The purse can be worn in only one mode.

DISCLOSURE OF INVENTION

Broadly, this invention relates to head apparel of unitary construction which is adapted for wearing in four modes; and to the method for adapting the head apparel to such wearing modes. The head apparel has a plurality of flexible pieces joined along a circular path which is interrupted to define a pair of opposable pockets with a common access opening. Each of the flexible pieces has an appearance surface respectively characterizing one of the modes. The pieces are sufficiently flexible and manipulatable when reached through the access opening to compact the pieces so that they may be withdrawn from one of the pockets to form the pieces into a brimmed hat with certain of the respective appearance surfaces exposed to configure two of the four modes. Selective nesting of these two modes distinguishes the desired brimmed hat mode. Such flexibility and manipulatability also enables one to withdraw pieces from the other of the pockets through the access opening for forming the pieces as a turban with certain others of the respective appearance surfaces exposed to configure the other two of the four modes. Again, selective nesting of these two modes distinguishes the desired turban mode.

More particularly, the present invention relates to a convertible multipiece headpiece comprising a first appearance surface, a second appearance surface, a third appearance surface, a fourth appearance surface, a brim, a first pocket, and a second pocket. The four appearance surfaces and the brim are stitched together to form head apparel which can be worn as a brimmed hat in a first and a second mode, i.e., exposing the first appearance surface or the second appearance surface, respectively, and as a turban in a third and a fourth mode, i.e., exposing the third appearance surface or the fourth appearance surface, respectively. The four modes of wearing the head apparel are achieved by manipulating the head apparel's material from a first or second pocket. The first pocket is such that when the first appearance surface and the second appearance surface form the head apparel's inner or outer surface, the third appearance surface and the fourth appearance surface are hidden within the first pocket and can be pulled from the first pocket so that the third and fourth appearance surfaces form the head apparel's inner or outer surface as the first pocket is turned inside out. The second pocket is such that when the third appearance surface and the fourth appearance surface form the head apparel's inner or outer surface, the first appearance surface and the second appearance surface are hidden within the second pocket and can be pulled from the second pocket so that the first and second appearance surfaces form the head apparel's inner or outer surface as the second pocket is turned inside out.

Accordingly, because hats may serve so many different purposes, it is an object of this invention to provide a head apparel construction that embodies at least four modes of wearing wherein each mode serves a different function or appearance.

A further object of the invention is to assemble a plurality of differently appearing fabric parts into a head apparel of unitary stitched construction that can achieve four modes of wear, i.e., two different hat modes and two different turban modes, by manipulating the head apparel's fabric through a resultant pocket in the stitched construction of the head apparel.

Another object of the invention is to provide head apparel which is convertible for wear in four different appearance modes and in which a first nested pair of crushable first and third appearance surfaces has juxtaposed first free edges, and a second nested pair of crushable second and fourth appearance surfaces has juxtaposed second free edges, and in which the first nested pair is joined to the second nested pair by securing together a sufficient length of the first and second free edges to define an opening. The opening provides manual access to either the first and second appearance surfaces or the third and fourth appearance surfaces for selectively crushably withdrawing either the first or the second pair of appearance surfaces through the opening for converting the head apparel between pairs of appearance modes.

Another object of the invention is to provide a method for making head apparel from a plurality of crushable pieces having different appearance surfaces by assembling a first selection of the pieces into a pair of opposed first and third crown portions having respective first and third appearance surfaces facing outwardly and a first pair of juxtaposed edges, assembling a second selection of the pieces into a fourth crown portion having a fourth appearance surface facing inwardly and a third edge juxtaposed with the first pair of juxtaposed edges, partially connecting the first and third crown portions to the fourth crown portion along a sufficient portion of the three juxtaposed edges to form an opening, and assembling a third selection of the pieces into a second crown portion having a second appearance surface facing outwardly and a fourth edge juxtaposed with the third edge and the first pair of edges. The opening provides access to the third and fourth crown portions for withdrawing such crown portions through such opening so that the first appearance surface faces inwardly and the fourth appearance surface faces outwardly. The opening also provides access to the first and second crown portions for withdrawing such first and second crown portions through such opening so that the third appearance surface faces inwardly and the second appearance surface faces outwardly.

BEST MODE FOR CARRYING OUT THE INVENTION

Figure 1:
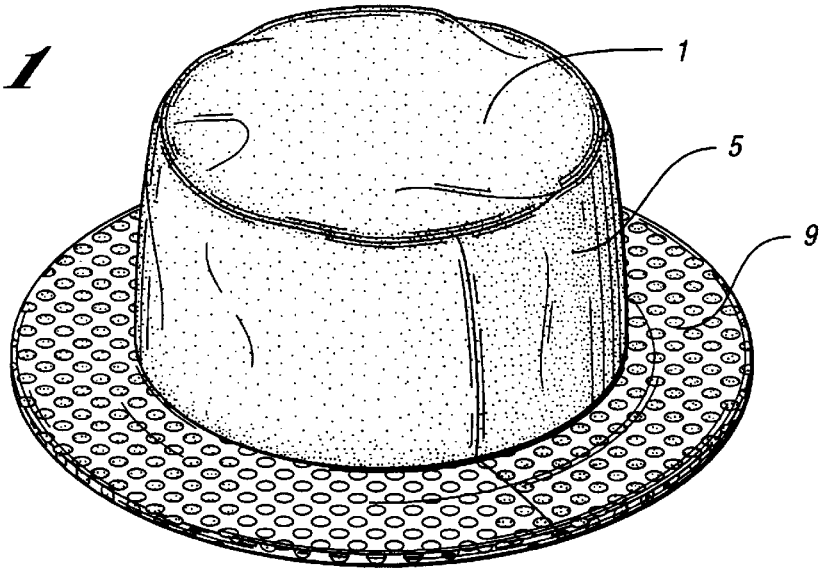
FIG. 1 is a perspective view of a convertible head apparel in a brimmed hat conversion having a first mode appearance surface according to the preferred embodiment of the present invention.

The ten pieces used to make the convertible head apparel are shown in FIGS. 7*a*–7*j*. The ten pieces shown in FIGS. 7*a*–7*j* are sufficiently flexible or crushable that they can be crumpled up when joined for manipulation through a small opening, such as five inches across. The pieces consist of hat circles 1 and 2, FIGS. 7*a* and 7*b*, respectively, and turban circles 3 and 4, FIGS. 7*c* and 7*d*, respectively, each approximately 8 inches in diameter, hat centers 5 and 6, FIGS. 7*e* and 7*f*, respectively, approximately 5 inches wide by 24 inches long, and turban centers 7 and 8, FIGS. 7*g* and 7*h*, respectively, approximately 6 inches wide by 24 inches long, and brim pieces 9 and 10, FIGS. 7*i* and 7*j*, respectively, approximately 3 inches wide by 30 inches long. The hat circles 1 and 2 join with hat centers 5 and 6 to form crown portions for a hat. The turban circles 3 and 4 join with turban centers 7 and 8 to form turban crown portions. The backside 9 of turban circle 4 and the backside 11 of turban side 8 are non-appearance surfaces.

Figure 8:
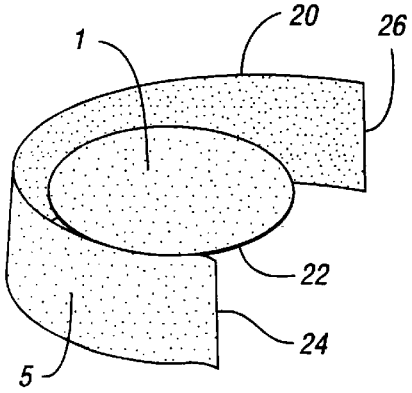
FIGS. 8–29 disclose progressive stitching steps in the method for assembling the convertible head apparel of this invention.
Figure 9:
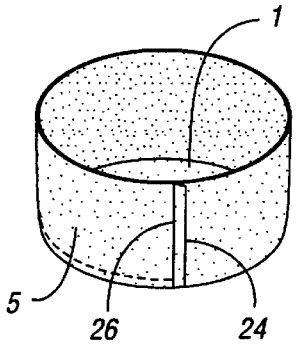

With reference to FIG. 8, the convertible head apparel is formed initially by placing hat circle 1 next to hat center 5. The length or long side 20 of hat center 5 is secured to hat circle 1 along approximately half of the circumference 22 of hat circle 1. Such securement may be by sewing machine stitching around the top edge ¼" from selvedge. Before hat center 5 is completely secured to hat circle 1 along the entire circumference 22 of hat circle 1, the first width or short side 24 of hat center 5 is secured to the second width or short side 26 of hat center 5, see FIG. 9. Then, the remainder of the length of hat center 5 is secured to the circumference of hat circle 1, see FIG. 10. This forms a hat crown which may include a hat circle 1 and a hat center 5. Of course, the short sides may be joined first followed by securing the outer circumference of the circle to the hat center.

Figure 11:
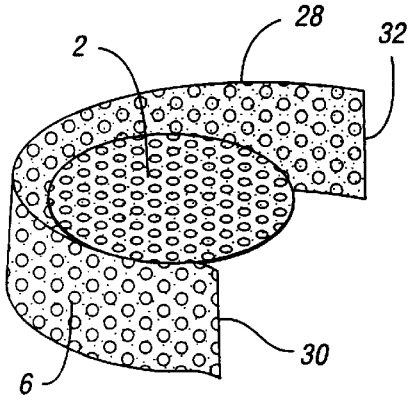
Figure 12:
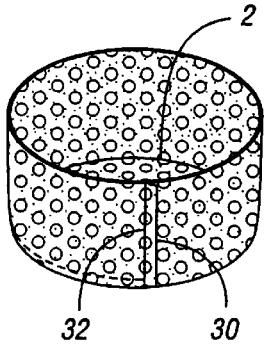
Figure 13:
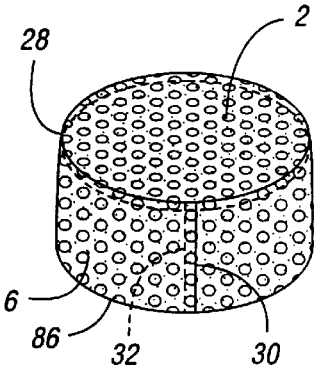

With reference to FIG. 11, the length or long side 28 of hat center 6 is secured to hat circle 2 along approximately half of the circumference of hat circle 2. Such securement may be by sewing machine stitching around the top edge ¼" from selvedge. Before hat center 6 is completely secured to hat circle 2 along the entire circumference of hat circle 2, the first width or short side 30 of hat center 6 is secured to the second width or short side 32 of hat center 6, see FIG. 12. Then, the remainder of the length of hat center 6 is secured to the circumference of hat circle 2, see FIG. 13. This forms another hat crown which may include hat circle 2 and hat center 6.

Figure 14:
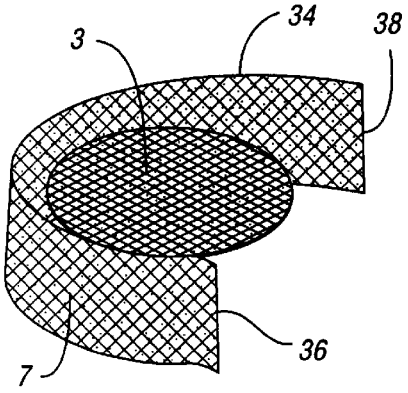
Figure 15:
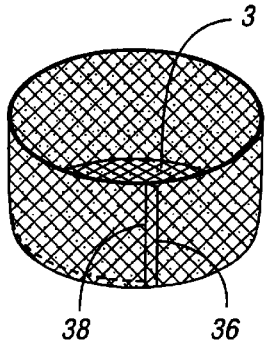

With reference to FIG. 14, the length or long side 34 of turban center 7 is secured to turban circle 3 along approximately half of the circumference of turban circle 3. Such securement may be by sewing machine stitching around the top edge ¼" from selvedge. Before turban center 7 is completely secured to turban circle 3 along the entire circumference of turban circle 3, the first width or short side 36 of turban center 7 is secured to the second width or short side 38 of turban center 7, see FIG. 15. Then, the remainder of the length of turban center 7 is secured to the circumference of turban circle 3, see FIG. 16. This forms a turban crown which may include a turban circle 3 and a turban center 7.

Figure 17:
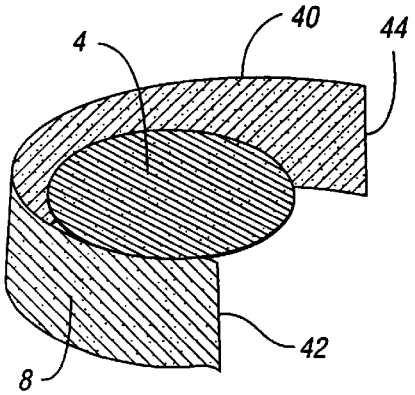
Figure 18:
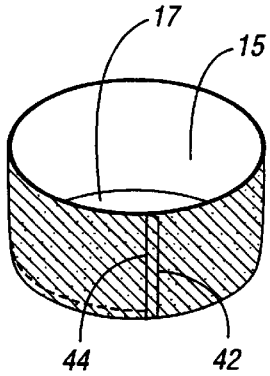
Figure 19:
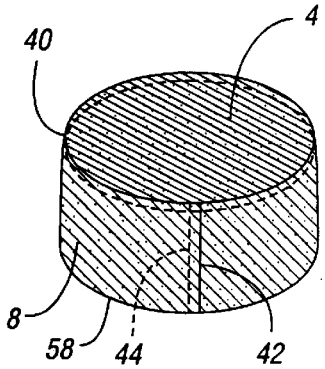

With reference to FIG. 17, the length or long side 40 of turban center 8 is secured to turban circle 4 along approximately half of the circumference of turban circle 4. Such securement may be by sewing machine stitching around the top edge ¼" from selvedge. Before turban center 8 is completely secured to turban circle 4 along the entire circumference of turban circle 4, the first width or short side 42 of turban center 8 is secured to the second width or short side 44 of turban center 8, see FIG. 18. Then, the remainder of the length of turban center 8 is secured to the circumference of turban circle 4, see FIG. 19. This forms a turban crown which may include a turban circle 4 and a turban center 8.

Figure 4:
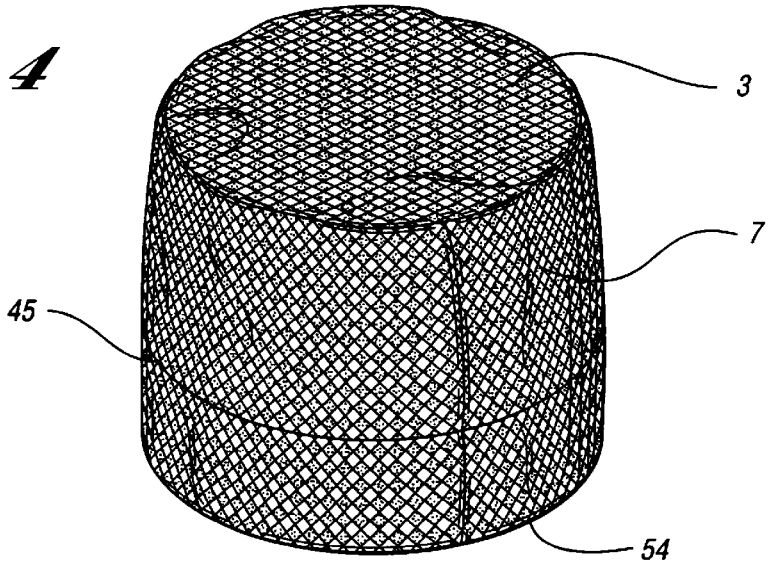
FIG. 4 is a perspective view of the convertible head apparel in a turban conversion having a third mode appearance surface according to the preferred embodiment of the present invention.
Figure 20:
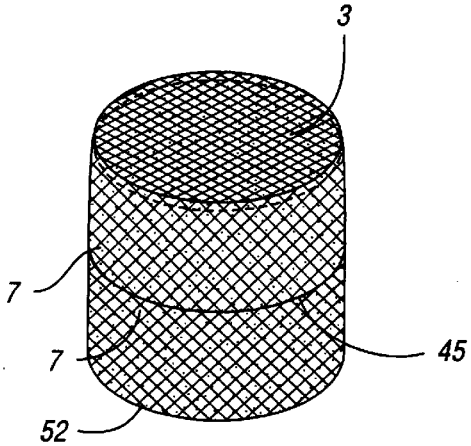

Next, the seam 45 in turban center 7 is formed by folding turban center 7 approximately in half along its length and stitching along the fold, see FIGS. 4 and 20. The seam 47 in turban center 8 is formed by folding turban center 8 approximately in half along its length and stitching along the fold, see FIGS. 5 and 21.

Figure 10:
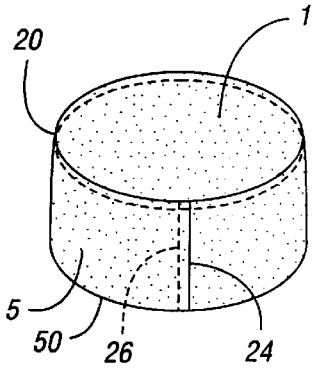
Figure 16:
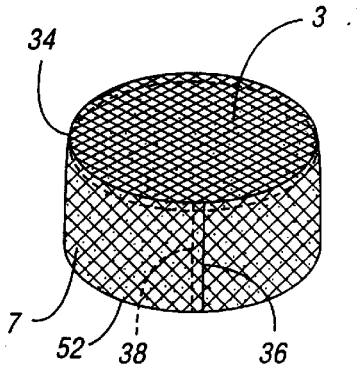
Figure 22:
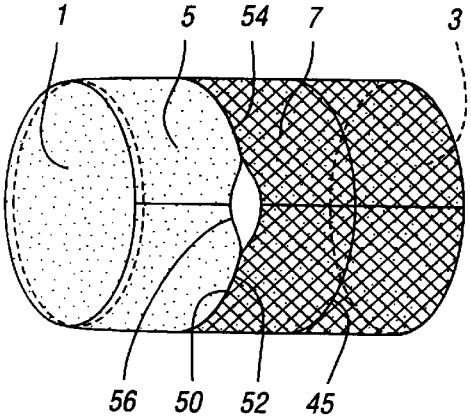

With respect to FIGS. 10, 16 and 22, the unattached circumferential length or free edge 50 of hat center 5 is partially secured to the unattached circumferential length or free edge 52 of turban center 7 along a seam at 54. An approximately two inch temporary opening 56 is left between the circumferential length 50 of hat center 5 and circumferential length 52 of turban center 7 along the seam at 54.

The material of hat center 5, hat circle 1, turban center 7, and turban circle 3 is pulled through the temporary opening 56 so that the means of securement or stitching of the unattached circumferential length 50 of hat center 5 to the unattached circumferential length 52 of turban center 7 at 54 is not visible on the outer surface of hat center 5, hat circle 1, turban center 7, and turban circle 3. The opening to the temporary pocket should be sufficient to allow manual access to the fabric forming the inside of the hat/turban centers so that the centers can be turned inside out.

Figure 21:
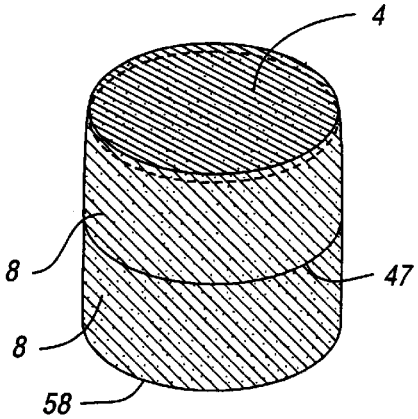
Figure 23:
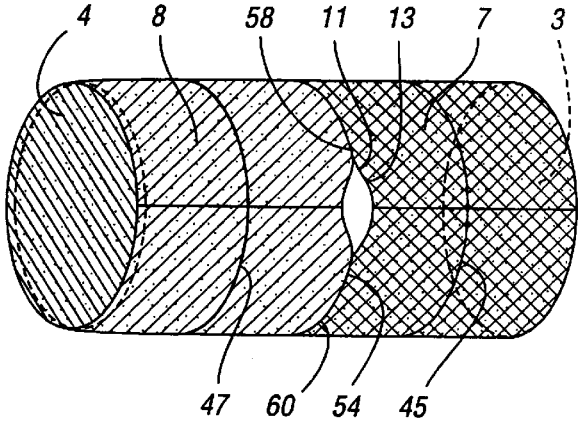

With respect to FIGS. 16, 21 and 23 and after nesting the FIG. 21 turban portion over the hat portion 1, 5 of FIG. 22, the circumferential length or free edge 58 of turban center 8 is secured to the shared circumferential length along the seam at 54 of hat center 5 and turban center 7 along a seam at 60. An approximately five inch opening 11 to permanent first or second pockets 12 and 13 (see FIGS. 3 and 6) is left unstitched between the circumferential length of the seam at 58 of turban center 8 and the shared circumferential length of the seam at 54 of hat center 5 and turban center 7. This forms a seam at 60. The opening 11 to the permanent pockets should be sufficient to allow manual access to the fabric pieces forming the inside of each pocket (ultimately hat circles 1 and 2 and hat centers 5 and 6 or turban circles 3 and 4 and turban centers 7 and 8) so that the selected pocket can be turned inside out repeatedly to change the mode from hat to turban and back.

Figure 24:
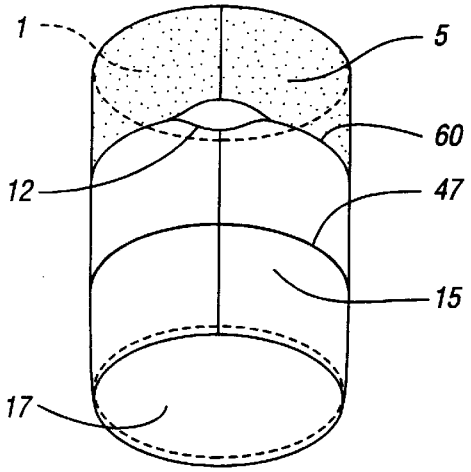

For instance to change the head apparel depicted in FIG. 23 to that depicted in FIG. 24, pull the material of hat center 5, hat circle 1, turban center 8, turban circle 4, turban center 7, and turban circle 3, from the second pocket 13 in FIG. 23. Arrange the hat according to FIG. 24 as an intermediate subassembly of the fabric parts ready for the hat brim 9, 10 and hat crown 2, 6. At this intermediate method step, the back, non-appearance surface 15 of turban center 8 and the back, non-appearance surface 17 of turban circle 4 are exposed.

Figure 25:
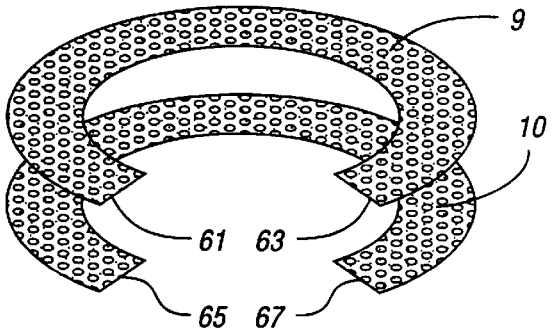
Figure 26:
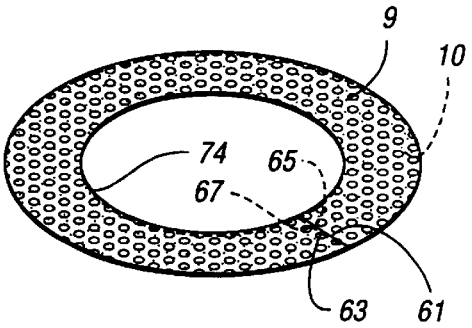

Now make the brim. Place the appearance surfaces of brim pieces 9 and 10 (see FIGS. 7*i* and 7*j*) face to face and stitch the outer circumference of brim piece 9 and its end edges 61, 63 to the outer circumference of brim piece 10 and its end edges 65, 67, see FIG. 25. The inner circumference of brim piece 9 is then partially secured or stitched to the inner circumference of brim piece 10. As before a two inch temporary opening (not shown) is left between the inner circumference of brim 9 and the inner circumference of brim 10. The material of brim 9 and brim 10 is manipulated through the opening so that the means of securement of brim 9 to brim 10 is not visible on the outer surface of brim 9 and brim 10. Then stitch across the two inch opening to close the brim along the brim's inner circumference 74 with appearance surfaces exposed, see FIG. 26. Also acceptable is to secure the outer circumference and the end edges. Then secure the raw edge at the inner circumference when the brim is secured to the edges of the hat crowns.

Figure 27:
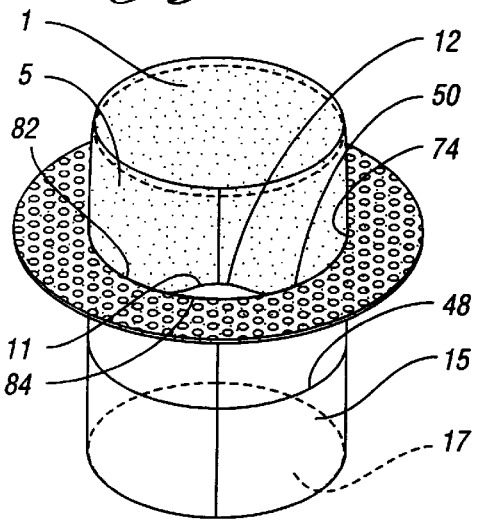

With reference to FIG. 27, the inner circumference 74 of closed and connected brim pieces 9 and 10 is partially secured to the circumferential length 50 of hat center 5 and turban center 7 at seam 60 along a seam 82. The five inch opening 11, now to the first pocket 12, is left intact between the inner circumference 74 of connected brims 9 and 10 and the circumferential length 50 of hat center 5 along 82. The unsecured five inch length of the inner circumference 74 of brim pieces 9 and 10 is secured to the circumferential length 58 of turban center 8 along 84. The backside non-appearance surface 15 of turban center 8 and the back, nonappearance surface 17 of turban circle 4 are exposed.

Figure 28:
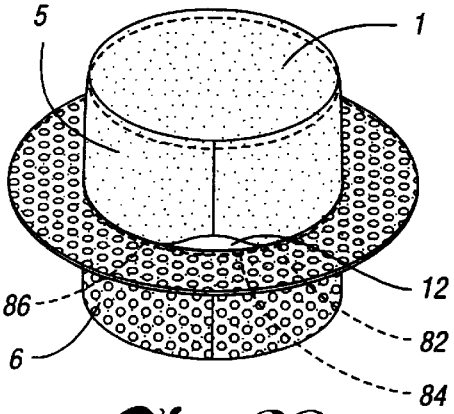

With reference to FIG. 28, unattached circumferential length 86 of hat center 6 is attached to the inner brim circumference 74 of connected brims 9 and 10 along seams 82 and 84. This covers up or conceals the non-appearance surfaces 15, 17 of the turban crown formed by turban circle 4 and turban center 8.

Figure 29:
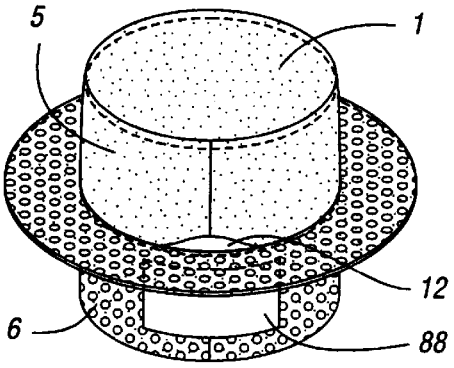

With reference to FIG. 29, a logo 88 may be stitched onto the hat center 6.

The four modes of the convertible head apparel are shown in FIGS. 1, 2, 4 and 5. FIG. 1 shows the convertible head apparel as a hat in the first mode of wear for the convertible head apparel. The convertible head apparel's first appearance surface is comprised of hat circle 1, hat center 5, and brim 9. In the preferred embodiment of the invention, hat circle 1 and hat center 5 are a khaki color or fabric. Brim 9 is a blue denim color or fabric.

Figure 2:
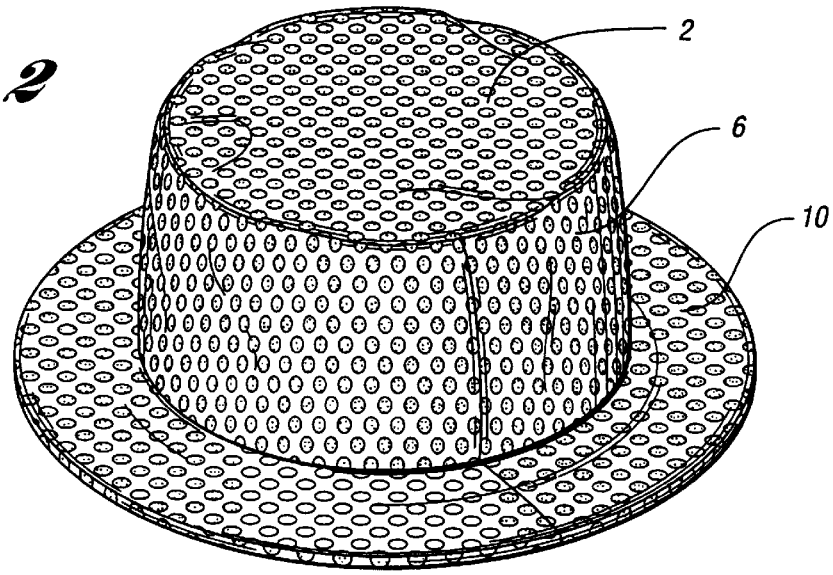
FIG. 2 is a perspective view of a convertible head apparel in another brimmed hat conversion having a second mode appearance surface according to the preferred embodiment of the present invention.

FIG. 2 shows the convertible head apparel as a hat in the second mode of wear for the convertible head apparel. Thus the FIG. 2 mode is the FIG. 1 mode inverted to expose what was inside the FIG. 1 mode and with the brim top side becoming the brim bottom side. The convertible head apparel's second appearance surface is comprised of hat circle 2, hat center 6, and brim 10. In the preferred embodiment of the invention, hat circle 2, hat center 6, and brim 10 are a blue denim color or fabric.

FIG. 4 shows the convertible head apparel as a turban in the third mode of wear for the convertible head apparel. The convertible head apparel's third appearance surface is comprised of turban circle 3 and turban center 7. In the preferred embodiment of the invention, turban circle 3 and turban center 7 are a plaid material.

Figure 5:
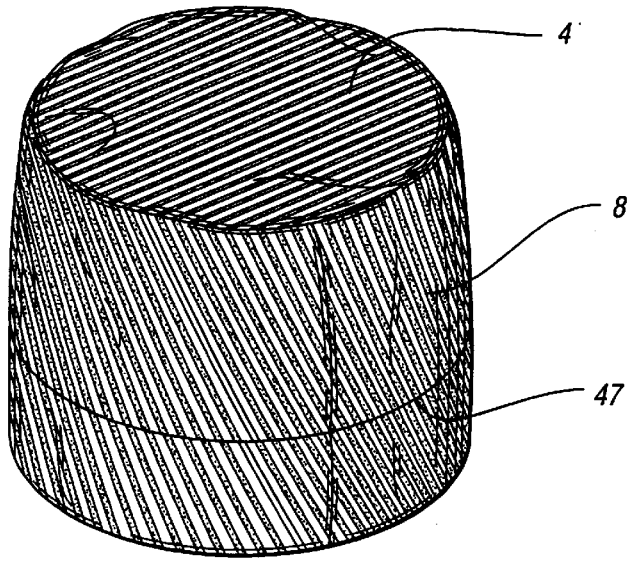
FIG. 5 is a perspective view of a convertible head apparel in another turban conversion having a fourth mode appearance surface according to the preferred embodiment of the present invention.

FIG. 5 shows the convertible head apparel as a turban in a fourth mode of wear for the convertible head apparel. Thus the FIG. 5 mode is the FIG. 4 mode inverted to expose what was inside the FIG. 4 mode of wear. The convertible head apparel's fourth appearance surface is comprised of turban circle 4 and turban center 8. In the preferred embodiment of the invention, turban circle 4 and turban center 8 are a brown soft or velvet material.

Figure 3:
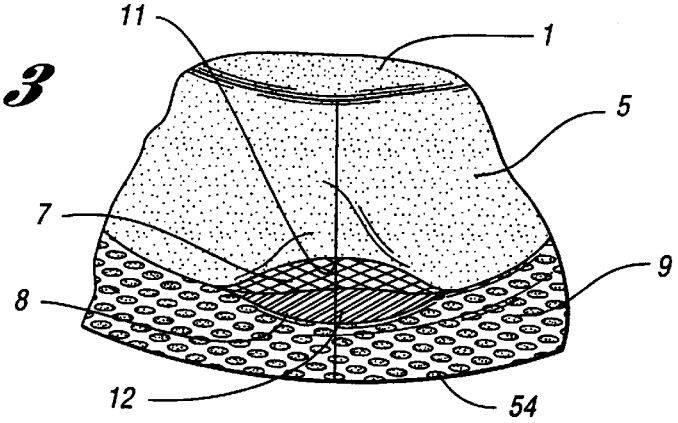
FIG. 3 is a fragmentary perspective view of the brimmed hat conversion of FIG. 1 showing a first pocket and an access opening in the convertible head apparel for reaching into the first pocket to convert the head apparel from a brimmed hat to a turban.
Figure 6:
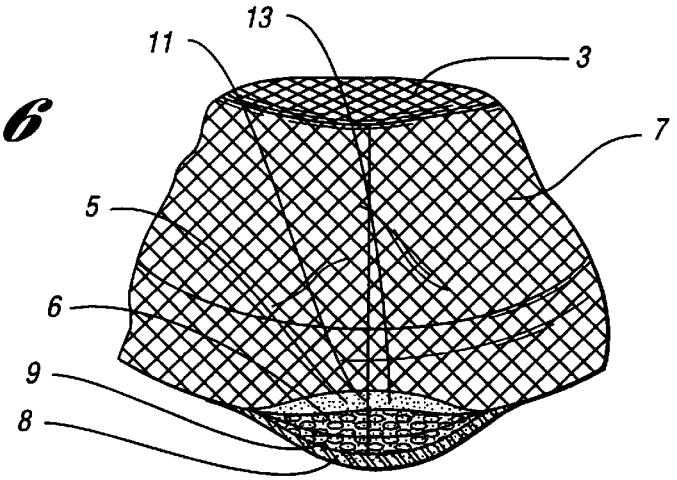
FIG. 6 is a fragmentary perspective view of the turban conversion of FIG. 4 showing a second pocket and the access opening in the convertible head apparel for reaching into the second pocket to convert the head apparel from a turban to a brimmed hat.
Figure 7A:
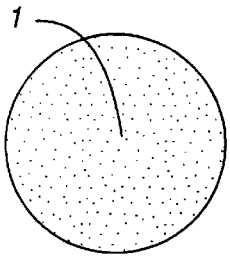
FIGS. 7*a*–7*j* are schematic elevational views of the ten differently shaped swatches of material usable in assembling the preferred embodiment of the convertible head apparel when stitched together in accordance with the method of this invention.
Figure 7B:
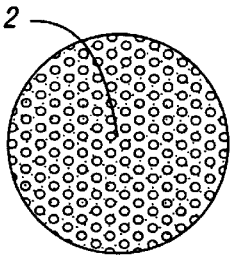
Figure 7C:
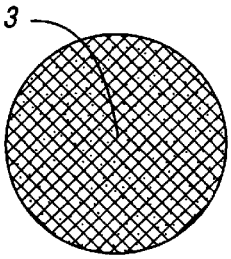
Figure 7D:
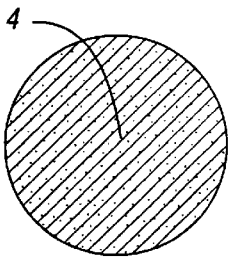
Figure 7E:
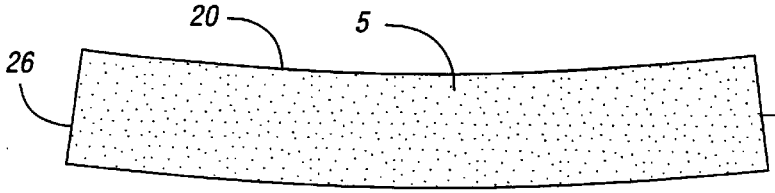
Figure 7F:
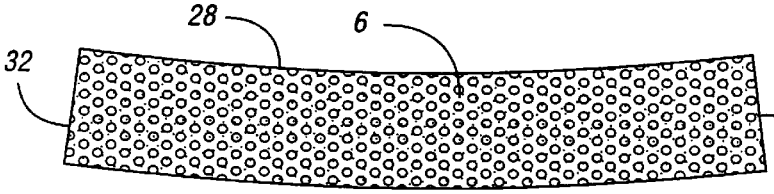
Figure 7G:
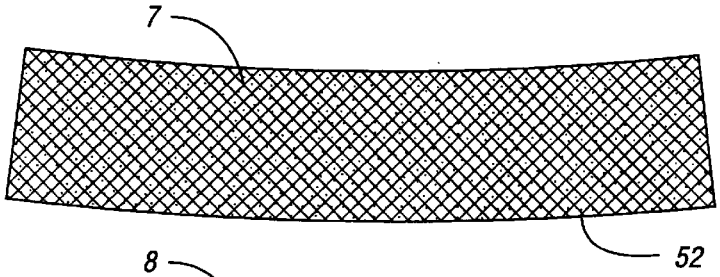
Figure 7H:
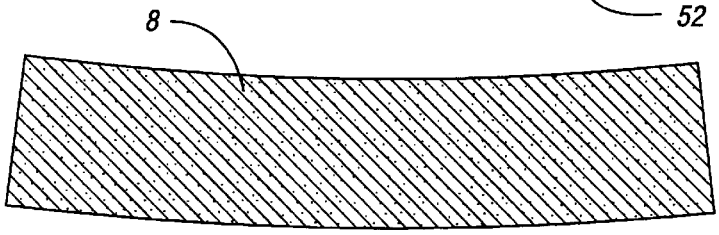
Figure 7I:
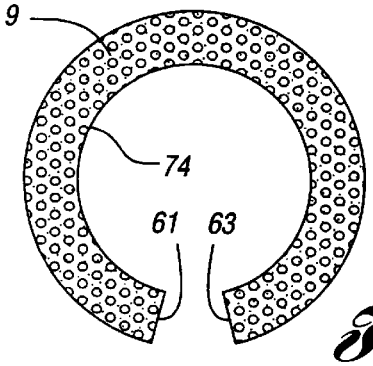
Figure 7J:
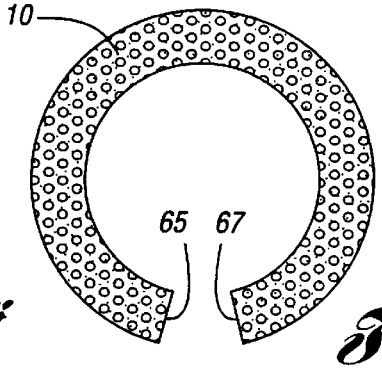

The convertible head apparel is transformed from the hat modes to the turban modes and from the turban modes to the hat modes by pulling material through the opening 11 of either the convertible head apparel's first pocket 12 in FIG. 3 or the second pocket 13 in FIG. 6. FIG. 3 shows that turban center 7, turban circle 3, turban center 8, and turban circle 4 are pulled from the first pocket 12 to transform the hat into a turban. Turban center 7, turban circle 3, turban center 8, and turban circle 4 are pulled from the first pocket 12 until the convertible head apparel's third appearance surface and the convertible head apparel's fourth appearance surface form the turban's visible surface area. At the same time the convertible head apparel's first appearance surface and the convertible head apparel's second appearance surface, including the brim, are hidden from view within the second pocket 13. Only a bit of the brim underside 9 shows at the opening 11 of second pocket 13 (see FIG. 6).

FIG. 6 shows that the hat center 5, hat circle 1, hat center 6, hat circle 2, and the brim 9, 10 may be pulled from the second pocket 13 to transform the turban modes into the hat modes. Hat center 5, hat circle 1, hat center 6, hat circle 2, and brim 9, 10 are pulled from the second pocket 13 until the convertible head apparel's first appearance surface and the convertible head apparel's second appearance surface form the hat's visible surface area. At the same time the convertible head apparel's third appearance surface and the convertible head apparel's fourth appearance surface are hidden from view within the first pocket 12 (see FIG. 3).

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. For example, additional pockets defined by additional fabrics having other appearance surfaces may be formed along the common seam of the juxtaposed hat and turban centers. Also certain of the appearance surfaces may be weatherproof or sun-reflective. Other appearance surfaces could represent different sport teams or events.

What is claimed is:

1. A head apparel of unitary construction adapted for wearing in a plurality of modes and comprising:

a plurality of edged crown portions each having at least one appearance surface;

selected edges of the crown portions being sufficiently partially joined so that at least one appearance surface is exposed in at least one of the wearing modes and a pair of pockets is defined;

one of the defined pockets storing certain of the crown portions when the head apparel is worn in two of the wearing modes; and the other of the defined pockets storing certain others of the crown portions when the head apparel is worn in two others of the wearing modes.

2. The head apparel of claim 1 wherein at least one of the edged crown portions is comprised of a circle portion and a side portion forming the edge.

3. The head apparel of claim 1 wherein one of the crown portions nests the others of the crown portions when the head apparel is worn in any one of the plurality of modes.

4. The head apparel of claim 1 wherein the plurality of modes is four.

5. The head apparel of claim 1 including an edged brim portion having an inner edge and at least one appearance surface, the inner edge of the brim portion being joined along with the selected edges of the crown portions for storing with certain of the crown portions so that the appearance surface of the brim portion is exposed in the at least one of the wearing modes.

6. A hat/turban of unitary construction adapted for wearing in four modes and comprising:

a plurality of flexible pieces joined along a circular path which is interrupted to define an opening and a pair of opposed selectable pockets, respectively, on opposite sides of the opening;

each of the flexible pieces having an appearance surface respectively characterizing one of the modes;

the pieces being sufficiently flexible and manipulatable through the opening to a selected pocket to compact the pieces for withdrawal from one of the pockets for forming the pieces as a hat with certain of their respective appearance surfaces adapted for exposure in two of the four modes or for withdrawal through the opening from the other of the pockets for forming the pieces as a turban with certain others of their respective appearance surfaces adapted for exposure in the other two of the four modes.

7. A multi-piece head apparel comprising:

a first appearance surface;

a second appearance surface;

a third appearance surface;

a fourth appearance surface;

a brim;

the first appearance surface being secured to the third appearance surface;

the fourth appearance surface being secured to the third appearance surface;

the brim being partially secured to the first appearance surface and partially secured to the fourth appearance surface;

the brim being secured to the second appearance surface;

a first pocket defined by the partial securement of the brim to the first appearance surface and existing between the first appearance surface and the second appearance surface;

a second pocket defined by the partial securement of the brim to the fourth appearance surface and existing between the third appearance surface and the fourth appearance surface;

the first pocket being such that when the first appearance surface and the second appearance surface form the head apparel's inner or outer surface, the third appearance surface and the fourth appearance surface are hidden within the first pocket and can be manipulated from the first pocket so that the third and the fourth appearance surfaces form the head apparel's inner or outer surface; and the second pocket being such that when the third appearance surface and the fourth appearance surface form the head apparel's inner or outer surface, the first appearance surface and the second appearance surface are hidden within the second pocket and can be manipulated from the second pocket so that the first appearance surface and the second appearance surface form the head apparel's inner or outer surface.

8. A method of making head apparel from a plurality of crushable pieces having different appearance surfaces, comprising, assembling a first selection of the pieces into a pair of opposed first and third crown portions having respective first and third appearance surfaces facing outwardly and a first pair of juxtaposed edges, assembling a second selection of the pieces into a fourth crown portion having a fourth appearance surface facing inwardly and a third edge juxtaposed with the first pair of juxtaposed edges, and partially connecting the first and third crown portions to the fourth crown portion along a sufficient portion of the three juxtaposed edges to form an opening, assembling a third selection of the pieces into a second crown portion having a second appearance surface facing outwardly and a fourth edge juxtaposed with the third edge and the first pair of edges, the opening providing access to the third and fourth crown portions for withdrawing such crown portions through such opening so that the first appearance surface faces inwardly and the fourth appearance surface faces outwardly, and the opening also providing access to the first and second crown portions for withdrawing such first and second crown portions through such opening so that the third appearance surface faces inwardly and the second appearance surface faces outwardly.

9. A head apparel convertible for wearing in a selected one of at least four appearance modes and comprising, a first nestable pair of crushable first and second appearance surfaces having juxtaposed first free edges, and a second nestable pair of crushable third and fourth appearance surfaces having juxtaposed second free edges, the first nestable pair being joined to the second nestable pair by securing together a sufficient length of the first and second free edges to define at least one opening, the at least one opening providing manual access to one of the first and second pairs of appearance surfaces for selectively crushably withdrawing the manually accessed one of the first and second pairs of appearance surfaces sufficiently through the at least one opening so that the head apparel may be convertible between the appearance surfaces of the accessed pair for wearing the head apparel in a selected one of the four appearance modes.

10. A head apparel convertible for wearing in a selected one of a plurality of appearance modes and comprising, at least a first nestable pair of crushable first and second appearance surfaces having juxtaposed first free edges, and at least a second nestable pair of crushable third and fourth appearance surfaces having juxtaposed second free edges, the first nestable pair being joined to the second nestable pair by securing together a sufficient length of the first and second free edges to define at least one opening, the at least one opening providing manual access to one of the first and second pairs of appearance surfaces for selectively crushably withdrawing the manually accessed one of the first and second pairs of appearance surfaces sufficiently through the at least one opening that the head apparel may be convertible between the appearance surfaces of the accessed pair for wearing the head apparel in a selected one of the appearance modes.

11. The head apparel of claim 10 including a pair of pockets, at least one of the pair of pockets connected to the at least one opening and being defined by the appearance surfaces of the manually accessed pair of appearance surfaces.

12. The head apparel of claim 10 including a pair of pockets enclosing respectively the first and second pairs of crushable appearance surfaces, each of the pair of pockets being connected to the at least one opening on opposite sides of the opening.

* * * * *